United States Patent [19]

Machanian et al.

[11] 4,254,682

[45] Mar. 10, 1981

[54] PRODUCTION OF CHORD NOTES IN A DIGITAL ORGAN

[75] Inventors: William V. Machanian, De Kalb; William R. Hoskinson, Geneva, both of Ill.

[73] Assignee: The Wurlitzer Company, De Kalb, Ill.

[21] Appl. No.: 917,305

[22] Filed: Jun. 20, 1978

[51] Int. Cl.[3] ..... G10H 1/38; G10H 5/00

[52] U.S. Cl. ..... 84/1.01; 84/DIG. 8; 84/DIG. 22; 84/DIG. 23

[58] Field of Search ..... 84/1.01, 1.03, DIG. 8, 84/DIG. 22, DIG. 23

[56] References Cited

U.S. PATENT DOCUMENTS

| | | | |
|---|---|---|---|
| 3,696,201 | 10/1972 | Arsem | 84/1.01 |
| 3,706,837 | 12/1972 | Arsem | 84/1.03 |
| 3,875,842 | 4/1975 | Kmetz | 84/1.01 |
| 3,951,028 | 4/1976 | Robinson | 84/1.03 |
| 3,954,039 | 5/1976 | Southard | 84/1.01 |
| 4,011,784 | 3/1977 | Fukui | 84/1.03 |
| 4,019,417 | 4/1977 | Carlson | 84/1.01 |
| 4,059,039 | 11/1977 | Carlson | 84/1.01 |
| 4,117,759 | 10/1978 | Kato | 84/DIG. 22 |
| 4,142,433 | 3/1979 | Gross | 84/1.01 |
| 4,147,085 | 4/1979 | Robinson | 84/1.01 |
| 4,148,241 | 4/1979 | Morez et al. | 84/1.03 |

*Primary Examiner*—Stanley J. Witkowski

*Attorney, Agent, or Firm*—Trexler, Wolters, Bushnell & Fosse, Ltd.

[57] ABSTRACT

The notes of an accompaniment manual of an electronic keyboard musical instrument such as an electronic organ are multiplexed. The key switches are sequentially scanned and the serial information produced is fed into a shift register. Digital circuitry reads the position of data in the shift register to determine whether a recognized chord has been played. After recognition of a recognized chord a counter operating in conjunction with the shift register clock input operates in connection with comparators and frequency generators to produce the necessary notes for the chord played.

An automatic mode of operation also is provided in which only the key corresponding to the root partial of a chord need be played. By utilizing the mathematic relationships in a chord, the simple note played by depression of one key is extrapolated into a chord.

21 Claims, 8 Drawing Figures

Figure 1:
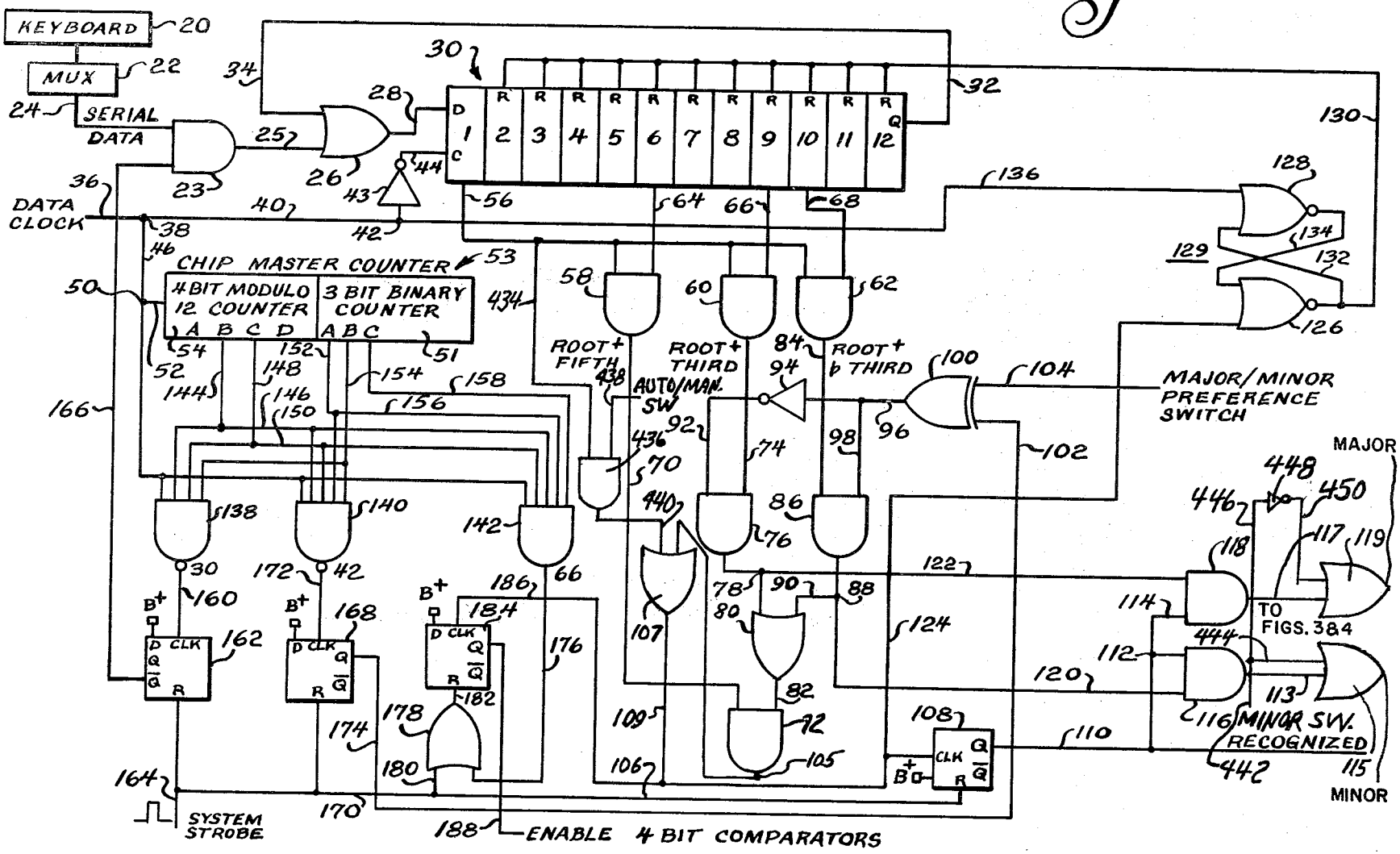

BASS OUT
432
430
418
420
422
424
426
428
390
386
402
396
408
414
KEYER
KEYER
KEYER
KEYER
KEYER
KEYER
392
FOURTH TRIGGER
385
ROOT TRIGGER
404
SIXTH TRIGGER
398
THIRD TRIGGER
410
FIFTH TRIGGER
416
ROOT-THIRD-FIFTH TRIGGER
388
FOURTH
400
SIXTH
SECONDARY FREQUENCY
THEREFORE FOURTH
THEREFORE SIXTH
384
394
406
412
PRIMARY FREQUENCY
ROOT
THIRD
FIFTH
ROOT-THIRD-FIFTH

PRODUCTION OF CHORD NOTES IN A DIGITAL ORGAN

BACKGROUND OF THE INVENTION

Electronic organs have been known in the Patent arts and in the marketplace for several decades. Such organs have generally operated on analog principles with the provision of one tone generator for each note of the organ. It has been common practice to use separate oscillators for each generator, or to provide twelve master oscillators for the top octave or one octave above the top octave with the divide-by-two circuits for producing the remaining octaves of the organ. More recently it has become rather common practice to provide a single high frequency master oscillator and to divide the frequency thereof by parallel dividing circuits of different divider ratios to provide the top octave of notes, such top octave being applied to strings of divide-by-two circuits to provide the gamut of the organ.

Chords can be played manually on the accompaniment keyboard of an organ, either electronic or wind, in accordance with techniques dating far back. Devices have been provided for electronic organs for the playing of chords simply upon depression of single buttons or single keys. In addition, rhythm devices for automatically producing rhythms have been used in electronic organs, and such rhythm devices have been used in conjunction with the playing of chords to play the chord notes sequentially.

More recently efforts have been made to produce electronic organs using digital techniques, including to some degree elimination or minimization of redundancy in the number of tone generators, and in multiplexing of keyboards. Techniques heretofore used in analog electronic organs are not necessarily directly translatable into digital electronic organs.

OBJECTS AND SUMMARY OF THE INVENTION

The broad objects of the present invention is to provide a digital organ eliminating generator redundancy and employing multiplexing with digital means for playing chords and for playing the chord notes in sequence.

In accordance with the present invention a digital organ is provided with a multiplexed keyboard. When a chord is played either manually or otherwise the multiplex signal is serially applied to a shift register. After a complete scan of the eighteen note chord section of the keyboard the shift register is read by appropriate digital circuitry to ascertain whether "1's" are in proper positions for a chord. If they are not, the shift register is circulated until a "1" stops in the root position. The shift register is then read for a third and fifth, and if "1's" are not found in the proper positions for a third and a fifth the shift register is again recirculated. A counter is used in connection with circulation of the shift register and this counter is connected to four comparators which are respectively connected to note storage latches associated with frequency generators whereby to cause the frequency generators to provide the proper frequencies for the chords selected.

An additional mode of operation is available with additions to the basic circuitry. This mode is termed "Automatic Chords" and permits the actuation of a complete chord from a single key. This mode is, of course, well known in prior art of electronic musical instruments. However, the prior art used techniques such as a multiple pole switch which actually activates several individual switches or a switch that addresses a word of read only memory to properly command the multiple notes. By utilizing the mathematical relationship of chord partials as described in the general case of manually entered keys, it is possible to extrapolate a single key (which represents the root partial of the chord) into the full chord. Since only one frequency is thus assigned to a note frequency generator directly from the keyboard the other generators must be forced in exactly the same manner as is the seventh partial. The normal keyboard to generator assignment algorithm determines which generator is available to accept each required frequency.

THE DRAWINGS

Figure 2:
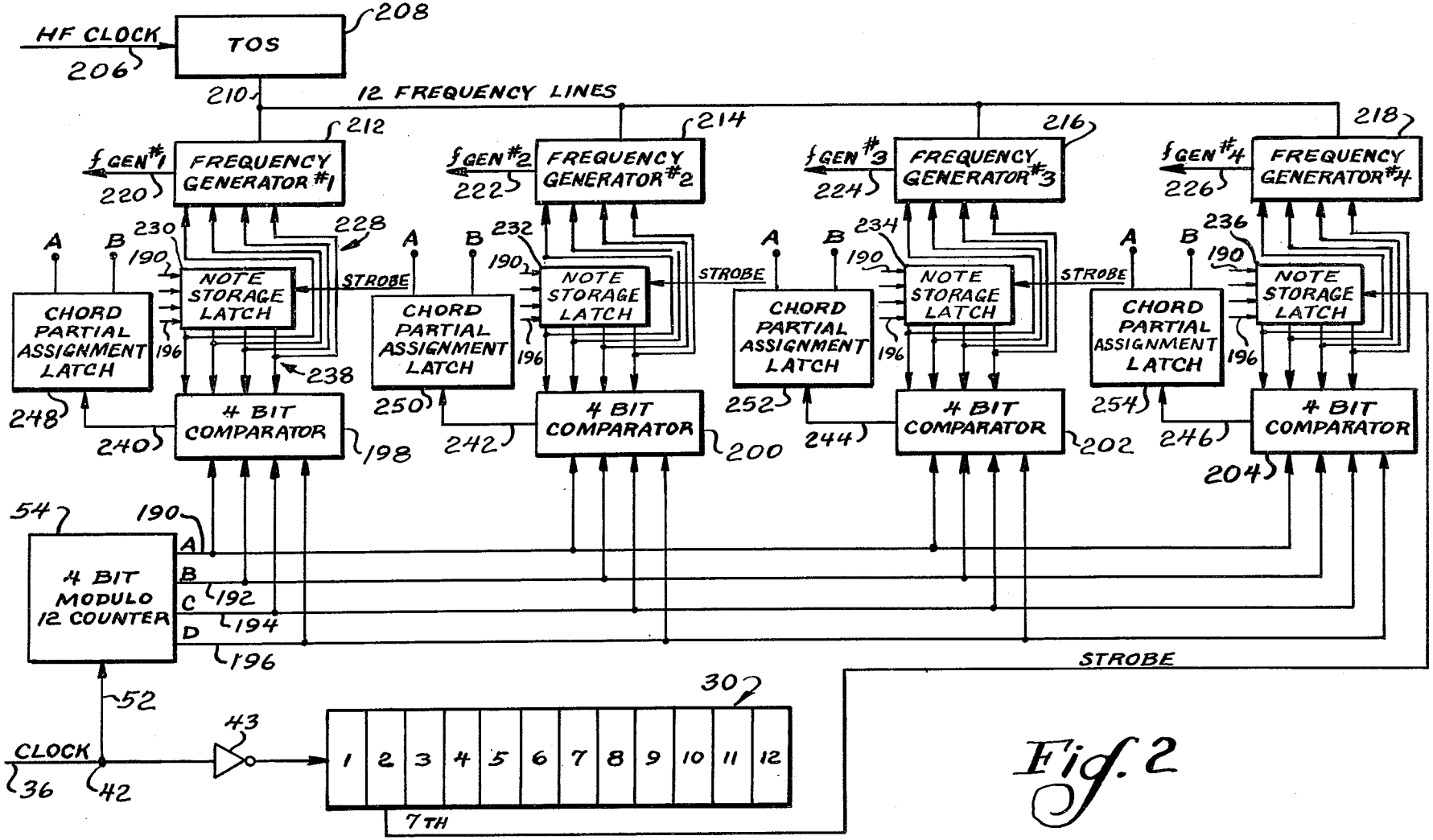
Figure 4:
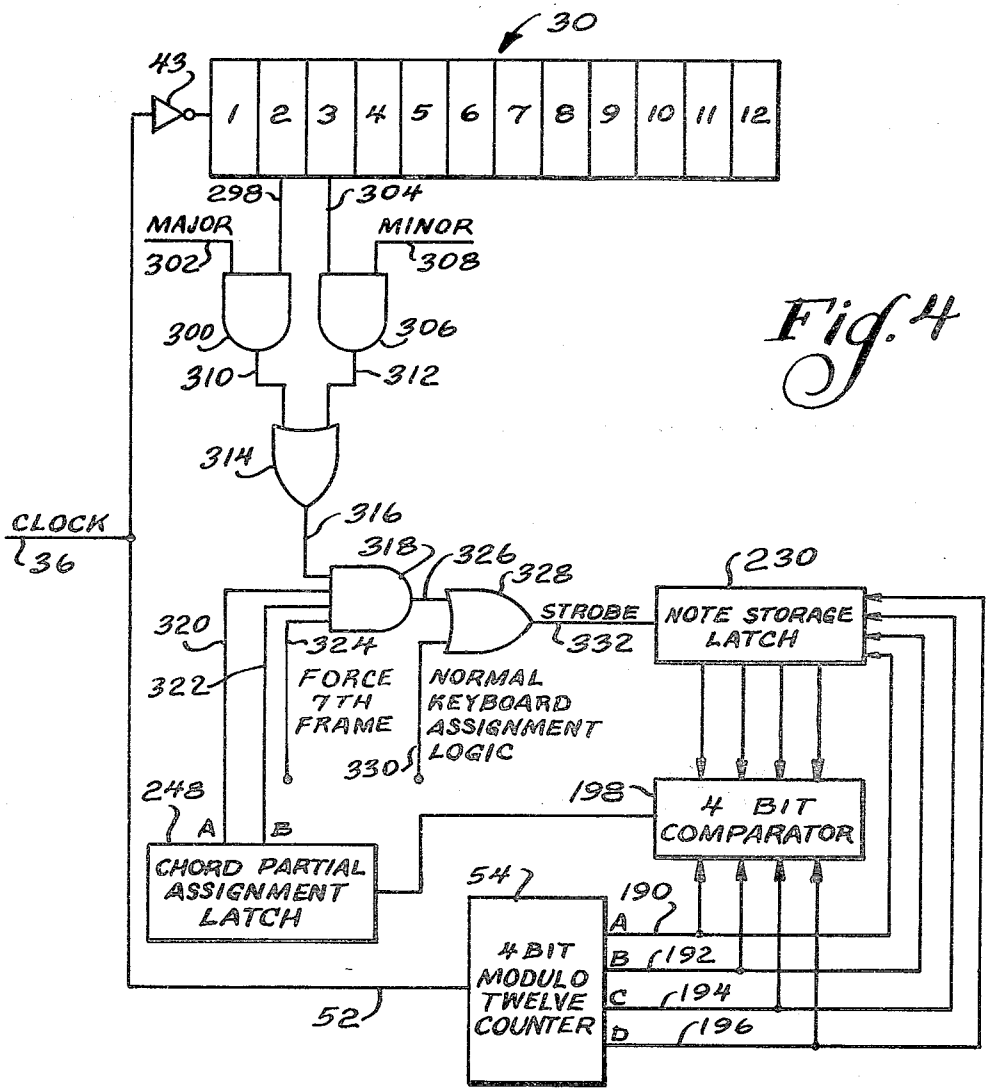
Figure 3:
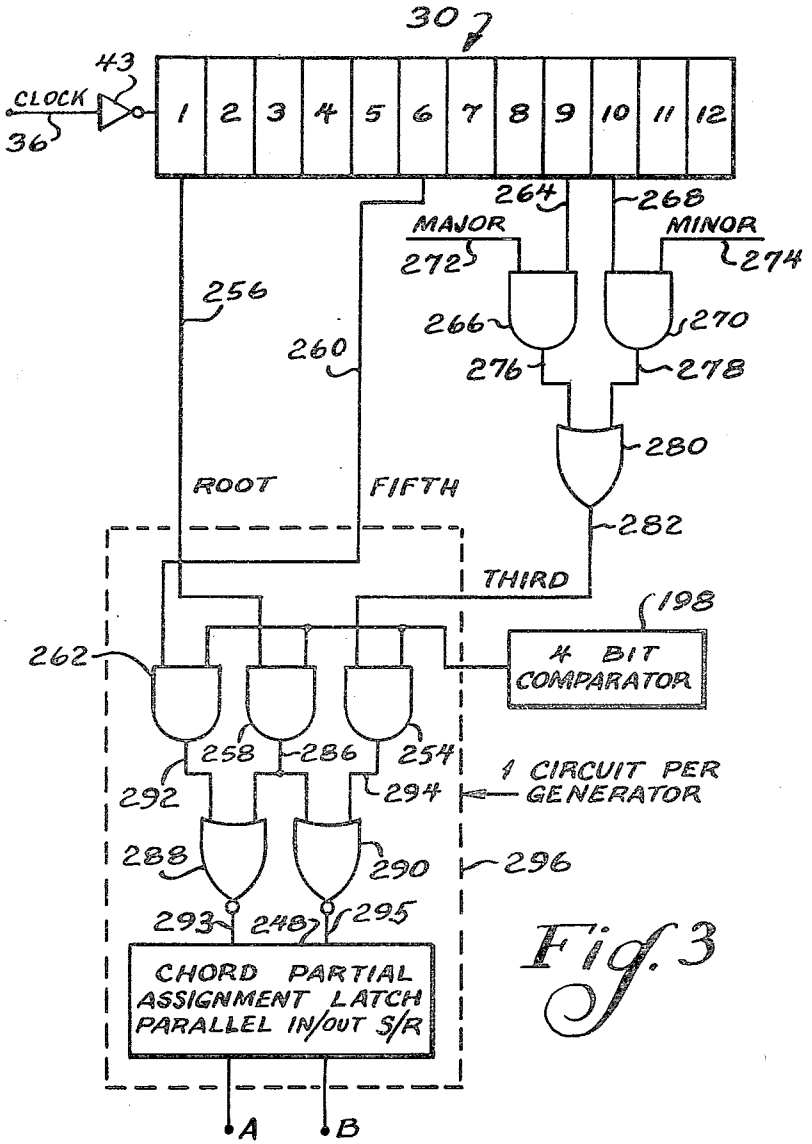
Figure 5:
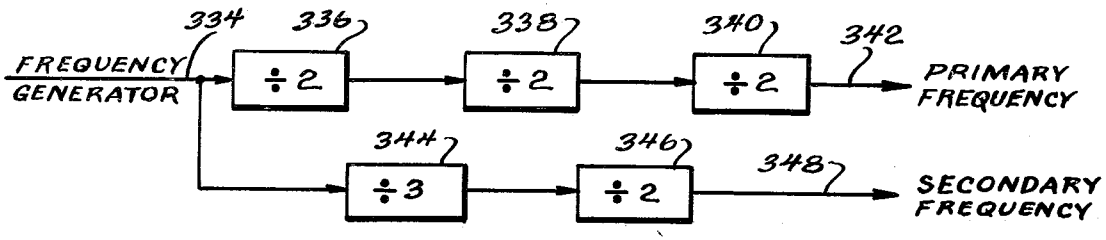
Figure 6:
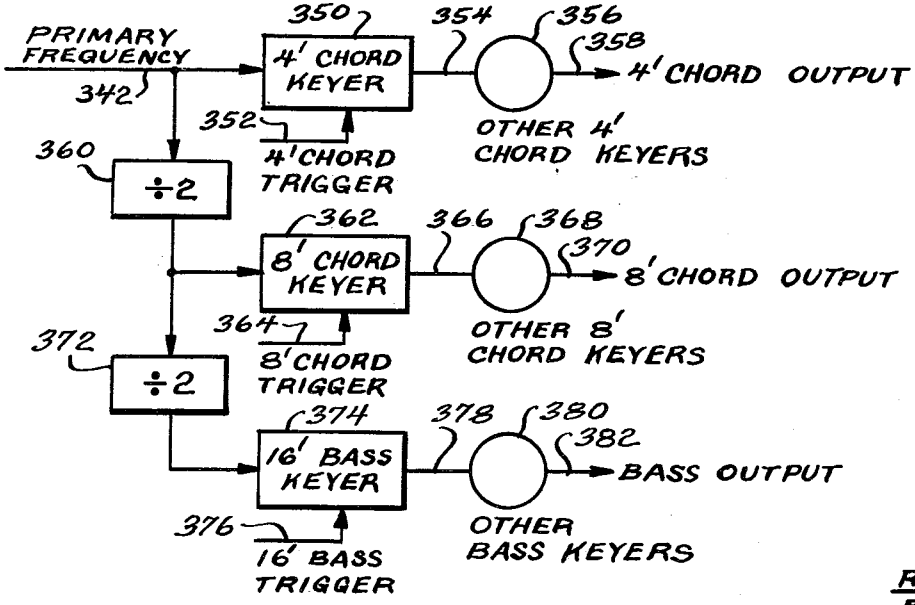
Figure 7:
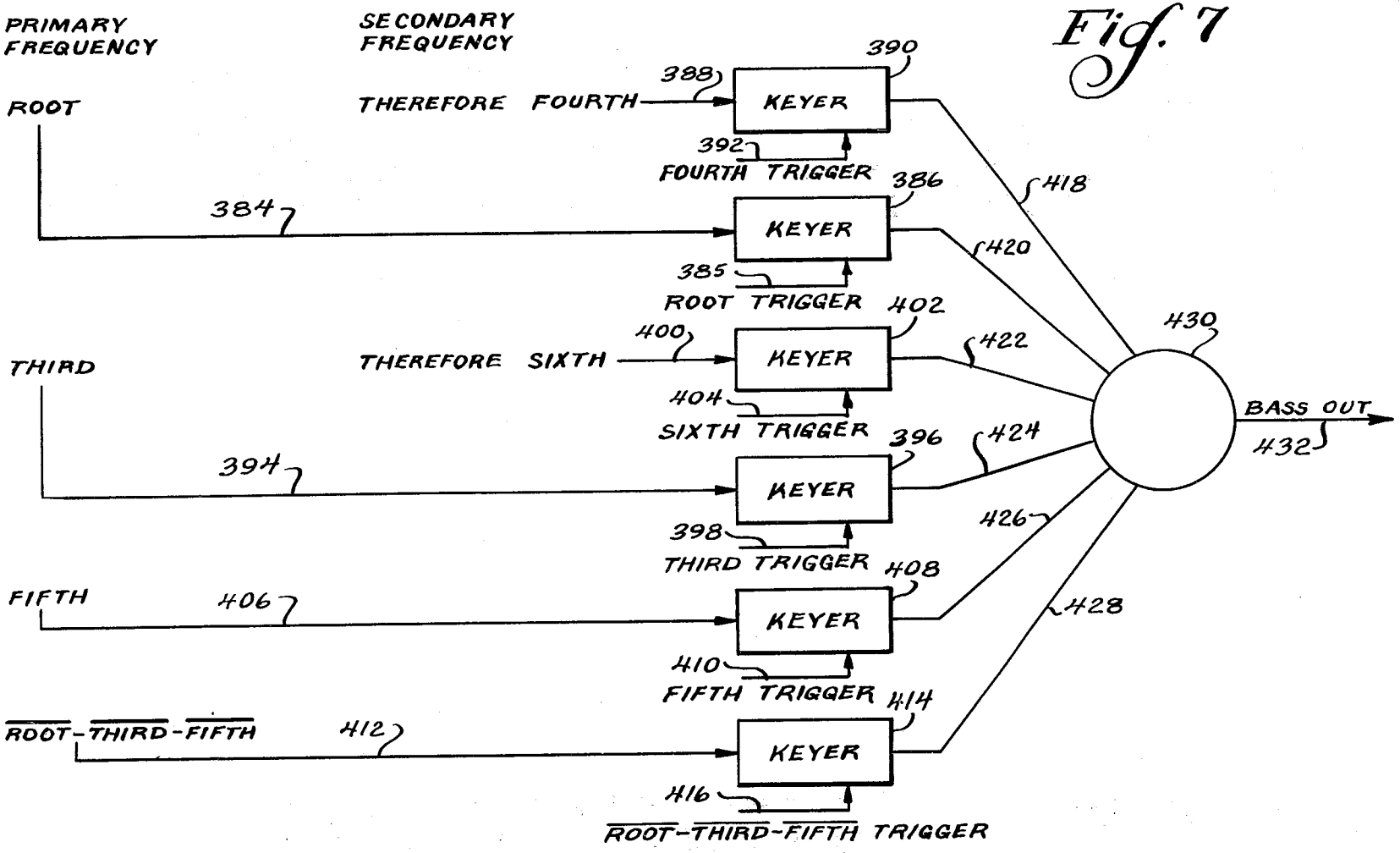

FIG. 1 comprises a block diagram for chord recognition;

FIG. 2 comprises a block diagram for comparison between a modulo 12 counter and a note storage latch for each chord frequency;

FIG. 3 comprises a block diagram for a chord partial assignment latch;

FIG. 4 comprises a block diagram illustrating forcing of a seventh partial on a generator note storage latch;

FIG. 5 comprises a block diagram of a typical frequency generator;

FIG. 6 comprises a block diagram of chord keyers and triggers;

FIG. 7 comprises a block diagram of bass keyers and triggers and

Figure 8:
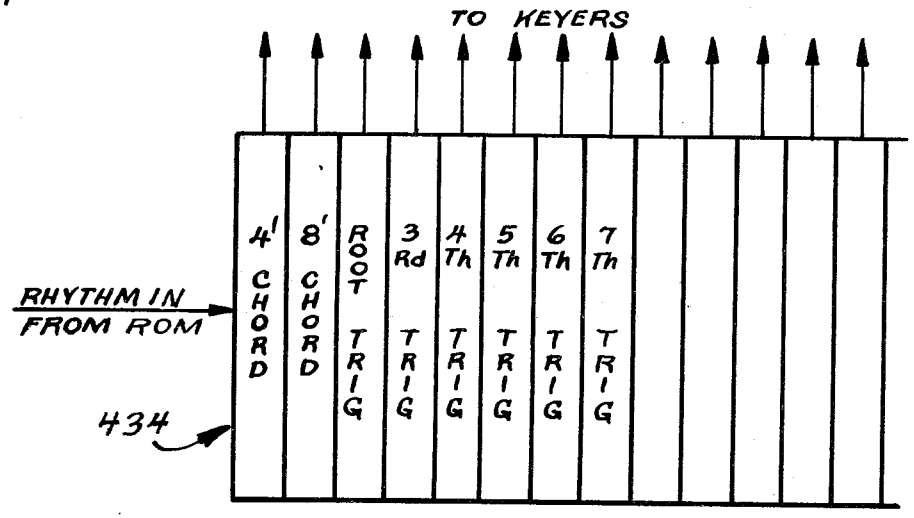

FIG. 8 comprises a block diagram illustrating a shift register and latch for trigger information.

DETAILED DISCLOSURE

Before turning to the drawings illustrating the electronic construction of the present invention it is best to consider some of the theory and operation of the present invention. Eighteen keys in the bass portion of the lower manual or accompaniment keyboard are established for chording in accordance with the present invention. For a sixty-one note keyboard these eighteen keys run from note C, key number 13, through the note F, key number 30, an octave and one half above the previously noted C. Such a keyboard starts with the note C one octave below the eighteen keys used for chording in accordance with the present invention. For a shortened keyboard of 37 and 44 notes the 18 key range would still start at note $C_{13}$, but closer to the bottom of the keyboard which might start with note F, for example.

The chords within the noted 18 key range can be played manually, or they can be played simply by depressing a single key with proper electronics for playing the remaining two notes to form a triad chord. The chord can either be latched or unlatched. In the latched mode a chord continues to play until another chord is played, even though the enabling key or keys may no longer be held down.

As noted heretofore multiplexing techniques are used. The multiplexing system sends information to subsequent electronics on large scale integrated circuit chips, subsequently to be disclosed in detail, to indicate which key switches are closed. In the latch mode the system inquires as to whether there are more keys depressed than on a previous scan. If so, the previous information assigned to the generator is cleared and the new state of the keyboard is loaded into the generator chip.

More specifically, the 18 keys referred to are scanned and the information is serially loaded into a 12 bit shift register. A 12 bit shift register (1 bit per note) is used rather than an 18 bit shift register (1 bit per key), because the mathematical relationship of a chord is dependent on the note keyed and not on the inversion at which the notes may be requested.

For example, consider the common C chord, notes C E G. If this chord is played on the manual the keyboard is scanned and the information read therefrom is serially loaded into a shift register. The shift register then will be in the state illustrated in the following table:

TABLE 1

| Bit No. | 1 | 2 | 3 | 4 | 5 | 6 | 7 | 8 | 9 | 10 | 11 | 12 |
|---|---|---|---|---|---|---|---|---|---|---|---|---|
| Note Represented | F | E | D# | D | C# | C | B | A# | A | G# | G | F# |
| Bit State | 0 | 1 | 0 | 0 | 0 | 1 | 0 | 0 | 0 | 0 | 1 | 0 |

A 1 in the bit state row indicates that a key (key switch) is active. Note that with scanning from base to treble the information, being entered serially, results in the order of notes reading from right to left with entry at the left end of the shift register.

To utilize the mathematical relationship between the notes of a major chord, bit number 1 of the shift register in the foregoing table 1 must be a 1. If a 1 is not present in the first stage of the shift register, as in the foregoing table 1, than the shift register will shift to the right until there is a 1 in the first stage or slot of the shift register, i.e., two shifts. This is represented as in the following:

TABLE 2

| Bit No. | 1 | 2 | 3 | 4 | 5 | 6 | 7 | 8 | 9 | 10 | 11 | 12 |
|---|---|---|---|---|---|---|---|---|---|---|---|---|
| Note Represented | G | F# | F | E | D# | D | C# | C | B | A# | A | G# |
| Bit State | 1 | 0 | 0 | 1 | 0 | 0 | 0 | 1 | 0 | 0 | 0 | 0 |

The mathematical relationship of the notes of a major chord is well-known. It follows that if a 1 is in the first stage or root position, then slot 9 or bit number 9 will be the third partial, and bit number 6 will be the fifth partial. If these conditions are not true (bit number 9≠1 or bit number 6≠1), as in the foregoing table 2, then the register will again shift right until a new 1 is entered in bit number 1 position, namely 5 shifts. The condition or state of the register then will be as follows:

TABLE 3

| Bit No. | 1 | 2 | 3 | 4 | 5 | 6 | 7 | 8 | 9 | 10 | 11 | 12 |
|---|---|---|---|---|---|---|---|---|---|---|---|---|
| Note Represented | C | B | A# | A | G# | G | F# | F | E | D# | D | C# |
| Bit State | 1 | 0 | 0 | 0 | 0 | 1 | 0 | 0 | 1 | 0 | 0 | 0 |

In this case all of the conditions for a major chord are present (bit number 1=1, bit number 6=1, and bit number 9=1), hence, a major chord is recognized. Once a chord is recognized, bits 2 through 12 inclusive are cleared of all information.

The foregoing applies as to major chords. Similar considerations apply as to minor chords. To utilize the mathematical relationship between the notes of a minor chord, bit number 1 of the shift register must be a 1. In this instance it is bit number 10 representing the flatted third partial that must have a 1, and bit number 6 again is the fifth partial. If these conditions are not true (bit number 10≠1 or bit number 6≠1), then the register again will shift right until a new 1 is entered in bit 1, i.e. 5 shifts, as in the foregoing explanation leading up to table 3. A chord still will not be recognized, and the shift register must then shift right again until a new one is entered in bit number 1 position, i.e., four shifts. This results in a register state as shown below:

TABLE 4

| Bit No. | 1 | 2 | 3 | 4 | 5 | 6 | 7 | 8 | 9 | 10 | 11 | 12 |
|---|---|---|---|---|---|---|---|---|---|---|---|---|
| Note Represented | E | D# | D | C# | C | B | A# | A | G# | G | F# | F |
| Bit State | 1 | 0 | 0 | 0 | 1 | 0 | 0 | 0 | 0 | 1 | 0 | 0 |

This is still not recognized as a minor chord, and the shift register must again shift right until a new "1" is entered in bit number 1, i.e., 3 shifts. The register state after the fourth shift right will be the same as the register state after the first shift right, as appears in Table 2. If no minor chord is recognized after 12 shifts of the register then the system will respond to the mathematical relationship of a major chord as heretofore set forth.

Chord Recognizer

Electronic circuits for effectuating the foregoing are shown starting with the chord recognizer shown in FIG. 1 wherein the keyboard is represented at 20 and will be understood as including the key switches. A multiplexing unit 22 provides serial data at 24 to an AND gate 23 having an output at 25 connected to one input of an OR gate 26.

The output 28 of the OR gate 26 leads to the first stage of a 12 stage shift register 30, their respective stages being labled 1 though 12, inclusive. An output 32 from the last stage is taken at Q and is fed back at 34 to the second input of the OR gate 26. A data clock input is provided at 36 to a junction 38, and it will be understood that the same data clock controls the multiplexing through appropriate connections in the multiplexing unit 22. A connection 40 leads from the junction 38 to a junction 42 which is connected through an inverter 43 to the conductor 44 leading to the C input to the shift register 30.

A connection 46 from the junction 38 leads to a junction 50, providing the input 52 to a 4 bit modulo 12 counter 54 having 4 outputs labeled A, B, C, and D. The modulo 12 counter 54 is integral with a 3 bit binary counter 51, also having outputs A, B, and C, the two counters together forming a chip master counter 53. All of the electronics shown in FIG. 1 with the exception of the keyboard and the multiplexing unit comprise a part of a single large scale integrated circuit chip.

A connection 56 leads from the first stage of the shift register 30 to 1 input of each of 3 AND gates 58, 60 and 62. A connection 64 is taken from stage 6 of the shift register leads to the second input of AND gate 58. A connection 66 leads from stage 9 of the shift register to the second input of AND gate 60, while connection 68 leads from stage 10 of the shift register to the second input of the AND gate 62.

The output of the AND gate 58 is connected at 70 to one input of an AND gate 72. The output of the AND gate 60 is taken at 74 to one input of an AND gate 76. The output of this AND gate leads to a junction 78, and to 1 input of an OR gate 80. The output of the OR gate is connected at 82 to the second input of the AND gate 72.

The output of the AND gate 62 is connected at 84 to one input of an AND gate 86 leading to a junction 88 connected at 90 to the second input of the OR gate 80.

The second input to the AND gate 76 is taken at 92 from an inverter 94 connected to a line 96. The line 96 also leads through connection 98 to the second input of the AND gate 86. The line 96 represents the output of an exclusive OR gate 100 having an input line 102 to which reference will be made shortly. A second input line 104 to exclusive OR gate 100 leads from an external, manual major/minor preference switch.

The outpt 105 of the AND gate 72 serves as one input to an OR gate 107 having an output 109 leading to conductor 106 which leads to the clock input of a D flip-flop 108 to provide a latched output at the Q output of the flip-flop, the latched output appearing on a connection 110 indicated as a recognized chord.

The recognized chord connection 110 leads to a junction 112 and to an input 114, respectively the first inputs of an AND gate 116 and an AND gate 118. The second input of the AND gate 116 is derived from a connection 120 leading from the junction 88, while the second input to the AND gate 118 is from a connection 122 connected to the junction 78, respectively indicating a minor or a major chord. The output 113 of AND gate 116 serves as one input to an OR gate 115 with a minor output. The output 117 of AND gate 118 serves as one input to an OR gate 119 having a Major output. A connection also is made from the recognized chord output 106, before the flip-flop, at 124 leading to one input of a NOR gate 126 interconnected with a NOR gate 128 to form an RS flip-flop 129 having an output at 130 leading to the resets of stages 2 through 12 inclusive of the shift register 30. The output of the NOR gate 126 is cross-connected at 132 to one input of the NOR gate 128, while the output of this latter NOR gate is cross-connected at 134 to the second input of the NOR gate 126. The second input to the NOR gate 128 comprises a connector 136 leading from the junction 42.

The line 46 from the data clock is connected to one input of a four input NAND gate 138 and also to one input of each of two five input NAND gates 140 and 142. A connection 144 from the B output of the 4 bit modulo 12 counter is connected to a line 146 leading to one input of each of the gates 138 and 140 and 142. Similarly, a lead 148 from the C output of the counter 54 leads to a connection 150 leading to one input of each of three gates 138, 140 and 142.

The A output of the 3 bit binary counter 51 has a lead 154 leading to a connection 156 connected to an input of the two five input gates 140 and 142, but not to the gate 138. The C output of the 3 bit binary counter 51 leads direct at 158 to the fifth input of the 5 input AND gate 142.

The output of the NAND gate 138 is connected at 160 to the clock input of a D flip-flop 162. The D input is connected direct to B+. The reset input is connected at 164 to the system strobe. The Q output is not connected, and the $\overline{Q}$ output is connected at 166 to the second input of the AND gate 23. The system strobe 164 also is connected to a D flip-flop 168 and to a connector 170 leading to the reset input of the previously mentioned D flip-flop 108. The D inputs of the flip-flop 168 and 108, and one more yet to be mentioned are connected to B+ similar to the D flip-flop 162. The output of the NAND gate 140 is connected at 172 to the clock input of the D flip-flop 168. The Q output is connected at 174 to the previously mentioned line 102 forming one input of the exclusive OR gate 100. The $\overline{Q}$ output is not connected.

The output of the AND gate 142 is connected at 176 to one input of an OR gate 178. The other input comprises a connection 180 from the system strobe line 170. The output of the OR gate 178 is connected at 182 to the reset input of a D flip-flop 184. The D input is connected to B+ as previously indicated, and the clock input is connected at 186 to the previously mentioned junction 106. The Q output is connected to a line 188 for enabling certain 4 bit comparators to be taken up hereinafter.

In considering operation of the circuit of FIG. 1 it must be understood that the shift register 30 is a negative edge triggering device, hence the inverter 43. The chip master counter 53 also is a negative edge triggering device, thus being operated by the trailing edge of the pulse rather than the leading edge.

At the start of each scan frame the first thing that transpires is a pulse on the system strobe to reset all of the internal circuitry and latches. From count 0 through count 30 the flip-flop 162 will have its $\overline{Q}=1$, thus allowing serial data to pass through the AND gate 23 and on to the input of the recirculating 12 bit shift register 30. At count 30 (as determined by the counter 53) this flip-flop will change state and serial data will be inhibited to the shift register. From counts 30 to 54 the chord recognizer will be operated to look for a recognized chord. Depending on the state of the major/minor preference switch connected at 104 the circuit will on counts 30 to 42 look for a major chord first or a minor chord first. Then from count 42 to 54 it will look for the opposite type of chord structure.

If during any of the 24 counts from counts 30 to 54 a chord is recognized, the RS flip-flop 129 will reset bits 2 through 12 of the 12 bit shift register to inhibit any other chord from being recognized from the entered data. Also on the recognition of a chord the D flip-flop 108 will provide a latched chord recognized signal. In addition to this, the D flip-flop 184 is set in order to provide an enable to the 4 bit comparators to be taken up hereinafter and which will be used in the next mode of operation to assign the chord notes to particular generators. Such assignment can be effected at any time after a chord has been recognized, and this could occur during any 12 successive counts between count 30 to count 66. At count 66 the D flip-flop 184 is reset through the OR gate 178 from the AND gate 142 to eliminate the possibility of any further change in assignment during the current frame of data.

As previously noted the modulo 12 counter 44 is operated by the pulses from the data clock at 36 in time relation with the operation of the shift register 30. Thus, during the scanning of the 18 notes under consideration there is a different count of the 4 bit modulo 12 counter 54 for each note shifted into the shift register. The count as it corresponds to the notes is as follows:

| Bit States | | | | |
|---|---|---|---|---|
| A | B | C | D | Note Represented |
| 0 | 0 | 0 | 0 | C |
| 1 | 0 | 0 | 0 | C# |
| 0 | 1 | 0 | 0 | D |
| 1 | 1 | 0 | 0 | D# |
| 0 | 0 | 1 | 0 | E |
| 1 | 0 | 1 | 0 | F |
| 0 | 1 | 1 | 0 | F# |
| 1 | 1 | 1 | 0 | G |

-continued

| Bit States A | B | C | D | Note Represented |
|---|---|---|---|---|
| 0 | 0 | 0 | 1 | G# |
| 1 | 0 | 0 | 1 | A |
| 0 | 1 | 0 | 1 | A# |
| 1 | 1 | 0 | 1 | B |

As will be appreciated there are 12 notes or semitones to an octave, whereby the modulo 12 counter repeats with the second half octave of notes entered. After the 12 shifts needed to serially load the shift register the 4 bits of the modulo 12 counter 54 will end in the following state:

| A(LSB) | B | C | D(MSB) |
|---|---|---|---|
| 1 | 0 | 1 | 0 |

LSB = Least Significant Bit
MSB = Most Significant Bit

The information on the 4 bits is encoded when a chord is recognized and is used for subsequent generator identification as hereinafter set forth in connection with the note frequency generator of FIG. 2.

Note Frequency Generator

The shift register 30 of FIG. 1 is shown again somewhat generally in FIG. 2 with no connections thereto except for the input data clock connection through the inverter 43. It will be recalled that the change in state of the D flip-flip 162 (FIG. 1) latched off the serial data input at the time a scan of the keyboard was complete. The 4-bit modulo 12 counter 54 of FIG. 1 is again shown in FIG. 2 with the outputs A, B, C, and D. The output at A is shown applied to a bus 190. The output B is applied to a bus 192, while the output C is applied to a bus 194, and the output bus D is applied to a bus 196. Each of the busses is individually connected to the four input connections on one side of four identical 4-bit comparators 198, 200, 202, and 204.

A master clock having a frequency on the order of 1–4 MHz is applied on line 206, labeled "H.F. Clock" into a top octave synthesizer 208, also noted as "TOS". Such synthesizers are well-known in the prior art and have generally comprised a single master oscillator of radio frequency with 12 parallel dividers of different divider ratios to provide the 12 semi-tones of the top octave of an organ. See for example Reyers U.S. Pat. No. 3,590,131. Also in non-redundant frequency generation a single divider can be supplied with one of twelve preset divider numbers to effect a 1-of-12 frequency generations. The output of the top octave synthesizer 208 comprises 12 frequency lines 210 leading in parallel to the inputs of 4 frequency generators 212, 214, 216, and 218. These four frequency generators are respectively labeled "frequency generator number 1" through "frequency generator #4". Associated with each of the frequency generators 212–218 is a note storage latch 230, 232, 234, and 236 respectively. Each of the note storage latches 230–236 are connected to outputs 190, 192, 194, and 196 from the 4 bit modulo 12 counter 54. The four generators 212–214 respectively have frequency outputs at 220, 222, 224, and 226. Output connections 228 from adjacent note storage latches 230, 232, 234, and 236, respectively lead to the four generators 212, 214, 216, and 218 for transfer of binary coded numbers related to the frequencies as stored in the latches 230–236. The four note storage latches further provide 4-bit binary numbers out at 238 to the comparators 198, 200, 202, and 204, respectively.

The comparators 198–204 have outputs 240, 242, 244, and 246 respectively connected to chord partial assignment latches 248, 250, 252 and 254 respectively. Each chord partial assignment latch has two outputs, in each case labeled A, and B.

Attention should be directed to the chord partial assignment latch 248 and associated circuitry shown in FIG. 3 and subsequently to the circuitry for forcing a 7th partial harmonic in FIG. 4 before considering the operation of the circuit in FIG. 2. Certain of the parts referred to heretofore are shown in these figures and identified with the identical numbers. Additional parts are shown in cooperation with the previously disclosed parts which were not shown heretofore as being irrelevant to the operation previously considered. Thus, in FIG. 3, the shift register 30 is shown with the clock pulses in at 36 for shifting the register. An output is taken from the first stage at 256 leading to one input of an AND gate 258. Another output is taken from stage 6 at 260 and leading to one input of another AND gate 262.

An output is taken from stage 9 at 264 leading to one input of an AND gate 266, while an output is taken at 268 from stage 10 leading to an AND gate 270. The second input to the AND gate 266 at 272 is connected with the output of the Major AND gate 118 in FIG. 1. Similarly, the second input 274 of the AND gate 270 is taken from the Minor output of the AND gate 116 of FIG. 1. The outputs 276 and 278 of the AND gates 266 and 270, respectively, comprise the input of an OR gate 280. The output of this OR gate at 282 leads to one input of an AND gate 284 illustrated as being next to the AND gates 258 and 262.

The output of the AND gate 258 leads at 286 to one input of each of two NOR gates 288 and 290. The output 292 of the AND gate 262 comprises the second input of the NOR gate 288, while the output 294 of the AND gate 284 comprises the second input of the NOR gate 290.

The outputs 293 and 295 of the NOR gates 288 and 290, respectively, lead to the chord partial assignment latch 248 comprising a parallel in, parallel out shift register having the outputs A and B as indicated.

The AND gates 258, 262, and 284, the NOR gates 288 and 290, and the chord partial assignment latch 248 are shown as within a broken line rectangle 296, since there is one such circuit 296 for each generator of FIG. 2.

Turning now to the seventh partial forcing circuitry of FIG. 4, stage 2 of the shift register 30 is shown as having an output 298 connected as one input to an AND gate 300. The second input 302 of this AND gate is from the AND gate 118 shown in FIG. 1. An output 304 from stage 3 of the shift register 30 leads to an AND gate 306, the second input 308 of which comes from the AND gate 116 of FIG. 1.

The outputs 310 and 312 of the AND gates 300 and 306, respectively, comprise the input of an OR gate 314. The output of this OR gate leads at 316 to an input of a 4-input AND gate 318. Two other inputs of this AND gate 318 lead at 320 and 322 from the A and B outputs of the chord partial assignment latch 248. The fourth input 324 is indicated as "Force Seventh Frame" about which more will be said later.

The output 326 of the AND gate 318 comprises an input of an OR gate 328. The second input 330 of this OR gate comes from "normal keyboard assignment logic" to be set forth hereinafter. The output 332 of the OR gate 328 comprises a strobe for the note storage latch 230.

In the description of operation of FIG. 1 it will be recalled that the D flip-flop 162 had been triggered after the first 30 counts to gate off the serial data from the multiplexing unit 22 to the OR gate 26. Recognition of a chord had sent a pulse from the output 106 of the AND gate 72 by way of the connection 124 to the RS flip-flop 129 to reset stages 2 through 12 of the shift register 30, thus leaving a 1 in stage 1 and 0's in stages 2 through 12. The data clock at 36 continues to provide clocking input at 44 into the shift register so that the 1 is moved along from stage to stage. Meanwhile, the D flip-flop 184 has an output on the line 188 to enable the 4 bit comparators.

At the same time the 3 notes played in a chord have respectively been assigned to the frequency generators 212, 214, and 216 in FIG. 2 generators 1 through 3. Such assignment is akin to addresses used in the computer arts, and is also known in the organ arts. In the present case the incoming keyboard data feeds a number into each note storage latch to assign a generator as disclosed in the copending application by Harold O. Schwartz and Dennis E. Kidd filed June 20, 1978 under Ser. No. 917,313 assigned to the same assignee as the present application, namely, The Wurlitzer Company of DeKalb, Illinois and now U.S Pat. No. 4,203,337. This has caused a binary code corresponding to the note to be entered into each of the three corresponding latches 230, 232, and 234. The output connections 228 between the respective latches and frequency generators causes a note to remain latched on even if playing thereof ceases until such time as a subsequent note is played.

Upon the recognition of a chord the system proceeds to identify each of the four frequency generators as partials of the chord. If a Major chord is recognized each of the four generators may have one of the following designations: root, third, fifth, or ($\overline{\text{root}}$ . $\overline{\text{third}}$ . $\overline{\text{fifth}}$). If a Minor chord is recognized then each of the four generators may have one of the following designations: root, flatted third, fifth, or ($\overline{\text{root}}$ . $\overline{\text{flatted third}}$ . $\overline{\text{fifth}}$).

The generator identification is accomplished by a comparison between the code on the note storage latches 230–234 (FIG. 2) and the code present on the 4 bit modulo 12 counter 54 (FIG. 1) at the time of comparison. A compare is made each time that the shift register has a 1 in stage 1, in stage 6, or stages 9 or 10. This 1 comprises the 1 circulated through the shift register which remained in stage 1 upon clearing of stages 2 through 12.

For example, consider a C Major chord, namely the notes CEG. The counter will be (from table 6) in the following state at such time:

| A | B | C | D |
|---|---|---|---|
| 0 | 0 | 0 | 0 |

This code in the counter represents the note "C". The note storage latch with the corresponding code is designated as root. When the shift register continues to shift due to the input from the data clock the 1 shifted over from stage 1 will appear in stage 6 after 5 clock periods. At this time a comparison is made and the generator storage latch with the corresponding code is designated as a fifth. The note in this case is a "G" identified by the following code:

| A | B | C | D |
|---|---|---|---|
| 1 | 1 | 1 | 0 |

In three more clock periods the 1 will have shifted over to stage 9. At this time a comparison is again made and the note storage latch which has the corresponding code to that in the counter is designated as a third. The note in this case is an E and is represented as follows:

| A | B | C | D |
|---|---|---|---|
| 0 | 0 | 1 | 0 |

Since a Major chord had been recognized comparison for the flatted third partial is not made. After the three comparisons above have been made if a generator has not been designated as root, third or fifth, the generator will be designated as: ($\overline{\text{root}}$ . $\overline{\text{third}}$ . $\overline{\text{fifth}}$).

When a chord is recognized and the correct partial is designated to a frequency generator the corresponding 2 bit chord partial assignment latch 248, 250, or 252 is set through the connections shown in FIG. 3 and described above. This latch outputs information which is encoded and used by the generator to determine output frequencies. The encoding is as follows:

| Bit State | | |
|---|---|---|
| A | B | Partial Represented |
| 0 | 0 | Root |
| 1 | 0 | Third |
| 0 | 1 | Fifth |
| 1 | 1 | $\overline{\text{Root}}$ . $\overline{\text{Third}}$ . $\overline{\text{Fifth}}$ |

The generator with the chord partial assignment 0, 0 outputs a primary frequency which is the root frequency of the chord. This generator also outputs a secondary frequency which is the fourth partial of the chord. This frequency is derived from the primary frequency by dividing by $\frac{3}{4}$. The generator with the chord partial assignment 1, 0 outputs a primary frequency which is the third partial of the chord. This generator also outputs a secondary frequency which is the sixth partial of the chord. This frequency is derived from the primary frequency by dividing by $\frac{3}{4}$. The generator with the chord partial assignment 0, 1 outputs only a primary frequency which is the fifth partial of the chord.

A representation of the primary and secondary frequency derivation is shown in FIG. 5. Thus, a frequency generator signal is applied at 334 as derived from the top octave synthesizer 208, or alternatively, a frequency something above the top octave but harmonically related thereto. The frequency at 334 is applied directly to a first series of 3 divide-by-two circuits 336, 338, and 340 arranged in sequence to provide the desired primary frequency at 342. The frequency at 334 also is applied to a parallel string of dividers comprising a divide-by-three divider 344 followed by a divide-by-two divider 346 to provide the secondary frequency at 348.

The generator with the chord partial assignment 1, 1 may either output a primary frequency which is the seventh partial of the chord, or it may output a primary frequency which the player may request by activating a fourth key on the manual. If the fourth key on the manual is not active, this generator will be forced to accept the state of the modulo 12 counter as its note storage latch state, see FIG. 4. The natural seventh partial, note input 324 in FIG. 4 is interconnected with the "Recognized" output line 110 in FIG. 1. The counter state is forced with stage 2 of the shift register comprises a 1. The flatted seventh partial is forced when a minor chord is recognized, the counter state being forced when stage number 3 of the shift register is a 1.

The actual keying of the chords is illustrated in FIG. 6. FIG. 6 represents one of four identical keying circuits, and the primary frequency is applied at an input at 342 corresponding to the primary frequency in FIG. 5. This frequency is applied directly to a 4 foot chord keyer 350 which is operated by a 4 foot chord trigger 352. The output of the chord keyer, which is a suitable semiconductor device such as a FET (field effect transistor) is connected at 354 to a combining station 356 at which the outputs 354 of the other 3 four foot chord keyers are connected to provide a four foot chord output at 358.

The primary frequency is also applied to a divide-by-two circuit 360 leading to an 8 foot chord keyer 362 having an 8 foot chord trigger 364 to provide an output at 366 leading to a combining station 368 to provide an 8 foot chord output at 370.

In addition, the output from the first divide-by-two circuit 360 is connected to another divide-by-two circuit 372 leading to a 16 foot bass keyer 374 having a 16 foot bass trigger 376 connected thereto. The output of this keyer at 378 is connected to a combiner 380 to provide a bass output at 382.

Bass keying to play the partials of the chord in time relation is effected in accordance with FIG. 7 Both primary and secondary frequencies are indicated as developed in accordance with FIG. 5. Thus, the root frequency is applied at 384 to a keyer 386 operated by a root trigger 388. The accompanying secondary frequency comprises a fourth partial at 388 applied to a keyer 390 controlled by a fourth trigger 392.

Similarly, the third partial frequency is applied at 394 to a keyer 396 controlled by a third keyer 398. The related sixth partial is applied at 400 to a keyer 402 controlled by a sixth trigger 404.

The fifth partial frequency is applied at 406 to a keyer 408 having a fifth trigger 410. There is no secondary frequency in connection with the fifth.

Finally, the ($\overline{\text{root}}$ . $\overline{\text{third}}$ . $\overline{\text{fifth}}$) frequency is applied at 412 (and it will be recalled that this can either be a seventh or a fourth key selected by the player) to a keyer 414 controlled by a ($\overline{\text{root}}$. $\overline{\text{third}}$. $\overline{\text{fifth}}$) trigger 416.

The outputs of the six keyers are all connected as at 418, 420, 422, 424, 426, and 428 to a combining point 430 to provide a bass output at 432.

Triggering information for the keyers is generated in a rhythm ROM, not shown herein. On each clock pulse the rhythm ROM is advanced one word and a frame of rhythm input data is transmitted to a shift register and latch 434 shown in FIG. 8. A 1 in any position effects triggering of the appropriate keyers as labeled. The information from the rhythm ROM is serially loaded into this shift register and latched. Each new frame of information clears the previous frame.

The invention as shown and described herein has referred to manual formation of chords. The invention applies equally well to chord formation by depression of a single key or by depression of a chord button, both of which are well-known in the art.

Portions of the circuit for playing of a chord from one key when playing in the automatic mode have been identified heretofore, including OR gate 107 and OR gates 115 and 119. Additional cooperating circuit parts for the automatic mode include a conductor 434 leading from connection 56 to one input of an AND gate 436. The other input 438 to the AND gate 436 is from an external auto/manual switch not shown. The output 440 serves as a second input to the OR gate 107 previously identified.

If the auto manual switch is in auto position there will be a "1" on the input 438 to the AND gate 436. If a "1" bit appears in the first stage of the shift register, there will be a second "1" on conductors 434 to the AND gate 436. This produces a "1" on the outputs 440 and 109 to the conductor 106 to indicate a recognized chord. The "1" bit in the shift register is circulated as heretofore described, and the third and fifth partial frequencies are forced in the same manner as heretofore described in connection with forcing of the seventh partial.

In order to recognize a Major or Minor chord in the automatic mode a remote minor switch (not shown) produces a "0" or a "1" on a line 442 which is connected to a second input 444 to the OR gate 115. The line 442 continues at 446 to an inverter 448 having an output 450 forming the second input to the OR gate 119. If the minor switch supplies a "1" to the line 442 the minor output of OR gate 115 is a "1". The inverter 448 puts a "0" on conductor 450 whereby the major output of the OR gate is "0". These outputs are reversed if there is a "0" on the line 442. The major and minor outputs are used as previously described.

The specific examples of the invention is herein shown and described is for illustrative purposes. Various changes will no doubt occur to those skilled in the art and will be understood as forming a part of the present invention insofar as they fall within the spirit and scope of the appended claims.

The invention is claimed as follows:

1. An electronic keyboard musical instrument comprising a keyboard having a plurality of key switches, multiplexing means interconnected with said key switches for providing serial data as to the relative positioning of at least one note played on said keyboard, memory means into which said serial data is serially transmitted, said serial data including information as to one or more chord notes played on said keyboard, means for recirculating the serial data in said memory means, circuit means for detecting the state of said serial data in said memory means, and chord structure recognizing means interconnected with said circuit means for providing an output signal when said serial data corresponds to a predetermined state corresponding to said at least one note played on said keyboard, said output signal identifying a chord structure partial identity corresponding to said at least one note played.

2. A musical instrument as set forth in claim 1 wherein said memory means comprises a shift register.

3. A musical instrument as set forth in claim 2 wherein said shift register has effectively twelve stages.

4. A musical instrument as set forth in claim 3 wherein the number of key switches is greater than the number of stages of said shift register, and wherein said shift register is recirculating.

5. A musical instrument as set forth in claim 2 wherein the number of key switches is greater than the number of stages of said shift register, and wherein said shift register is recirculating.

6. An electronic keyboard musical instrument comprising a keyboard having a plurality of key switches, a plurality of assignable tone generators, multiplexing means interconnected with said key switches and providing serial data as to the condition of said switches, said serial data also controlling assignment of at least one of said tone generators, a multi-state shift register into which said serial data is serially transmitted, parallel chord structure recognizing circuit means for detecting the state of said serial data in said shift register and including at least one gate having inputs connected to at least two stages of said shift register, the relative positions of said at least two stages corresponding to the relative positioning of the root and at least one partial of a predetermined chord structure and used to identify the chord structure partial identification of each note played.

7. A musical instrument as set forth in claim 6 further including a second gate having inputs from the shift register stages relatively positioned corresponding to the relative positions of the root and at least one other partial of said predetermined chord.

8. A musical instrument as set forth in claim 7 and further including a third gate in said last mentioned means, and means including manually operable means other than said key switches for selecting the output of either of said second and third gates in accordance with whether a Major or Minor chord is desired.

9. A musical instrument as set forth in claim 6 and further including means for effecting shifting of the data in said shift register in the event that serial data corresponding to said predetermined chord structure is not detected.

10. An electronic keyboard musical instrument comprising a keyboard having a plurality of key switches, multiplexing means interconnected with said key switches and providing serial data as to the condition of said switches, a multi-stage shift register into which said serial data is serially transmitted, parallel circuit means for detecting the state of said serial data in said shift register and including at least one gate having inputs connected to at least two stages of said shift register, the relative positions of said at least two stages corresponding to the relative positioning of the root and at least one partial of a predetermined chord structure, further including a second gate having inputs from the shift register stages relatively positioned corresponding to the relative positions of the root and at least one other partial of said predetermined chord and further including means effective upon detection of serial data corresponding to said predetermined chord structure for resetting all stages of said shift register except one predetermined stage, and means for thereafter advancing the bit from said one predetermined stage through said shift register.

11. An electronic keyboard musical instrument comprising a keyboard having a plurality of key switches, multiplexing means interconnected with said key switches for providing serial data as to the condition of said switches, a shift register, clock means for serially clocking said data from said multiplexing means to said shift register for a predetermined number of clock counts, means effective following said predetermined number of clock counts for gating said serial data off from the input of said shift register, parallel circuit means for detecting the state of said serial data in said shift register, means interconnected with said parallel circuit means for providing an output when said serial data correspond to a predetermined chord structure, and means for shifting the data in said shift register while the data gating means continues to gate serial data off when said serial data does not correspond to said predetermined chord structure.

12. A musical instrument as set forth in claim 11 wherein the means for shifting serial data in said shift register comprises a feedback path from the last stage of said shift register to the first stage thereof.

13. An electronic keyboard musical instrument comprising a keyboard having a plurality of key switches, a plurality of means producing electrical oscillations respectively corresponding to musical tones, electronic means interconnecting said key switches and three of said oscillation producing means for producing frequencies corresponding to a triad chord upon operation of three of said key switches, and second electronic means interconnecting said key switches and a fourth oscillation producing means to cause said fourth oscillation producing means to produce an additional related oscillation irrespective of whether a fourth key is depressed, said second electronic means comprising a note storage latch, means interconnected with said first mentioned electronic means for strobing said note storage latch means, a counter, a clock for operating said counter in synchronism with said first mentioned electronic means, means for comparing the states of said counter and of said note storage latch, the output of said comparing means controlling said fourth oscillation producing means.

14. An electronic keyboard musical instrument as set forth in claim 13 wherein the additional related oscillation comprises a musical seventh.

15. An electronic keyboard musical instrument as set forth in claim 13 and further including multiplexing means interconnected with said key switches and providing serial data as to the condition of said switches, memory means into which said serial data is serially transmitted, parallel circuit means for detecting the state of said serial data in said memory means, and means interconnected with said parallel circuit means and providing an output when said serial data corresponds to a predetermined chord played structure.

16. An electronic keyboard musical instrument comprising a keyboard having a plurality of key switches, a plurality of means producing electrical oscillations respectively corresponding to musical tones, electronic means enabling three of said oscillation producing means for producing frequencies corresponding to a chord upon operation of at least one of said key switches corresponding to said chord said electronic means further including a manually operable control other than said key switches for determining the frequency which at least one of the oscillation producing means will produce in response to operation of ones of said key switches which may correspond to more than one chord.

17. An electronic keyboard musical instrument as set forth in claim 16 and further including multiplexing means interconnected with said key switches and providing serial data as to the condition of said switches, memory means into which said serial data is serially transmitted, parallel circuit means for detecting the state of said serial data in said memory means, and means interconnected with said parallel circuit means and providing an output when said serial data corresponds to a predetermined chord structure.

18. An electronic keyboard musical instrument comprising a keyboard having a plurality of key switches, multiplexing means interconnected with said key switches for providing serial data as to the condition of said switches, memory means into which said serial data is serially transmitted, parallel circuit means for detecting the state of said data in said memory means, and means interconnected with said parallel circuit means for providing an output when said data corresponds to any of a plurality of predetermined chord structures, said last named means including a manually operable means for determining priority of response thereof as between a Major chord structure and a Minor chord structure.

19. An electronic keyboard musical instrument as set forth in claim 18 and further including a plurality of means producing electrical oscillations respectively corresponding to musical tones, electronic means interconnecting said key switches and three of said oscillation producing means for producing frequencies corresponding to a triad chord upon operation of said key switches, and electronic means interconnecting said key switches and a fourth oscillation producing means to cause said fourth oscillation producing means to produce an additional related oscillation irrespective of whether a fourth key is depressed.

20. An electronic keyboard musical instrument comprising a keyboard, switch means operable in conjunction with said keyboard, a plurality of assignable means for producing electrical oscillations respectively corresponding to musical tones, electronic means interconnecting said switch means and said assignable means for causing said assignable means to produce frequencies corresponding to a chord upon operation of said switch means, said electronic means including a manually operable control other than said key switches for determining which of two frequencies one of the assignable means will produce to define either a Major or a Minor chord.

21. A method for determining if a chord is being played on an electronic musical instrument including means for playing a plurality of notes, which method comprises storing a plurality of bits of information corresponding to notes played a first state of a bit indicating that a note is not being played and a second state indicating that a note is being played, shifting said information until a selected one of the bits is in the second state, determining the state of at least one additional bit chosen such that the relationship between the additional bit and the selected bit corresponds to the structure of a chord, both of said selected bit and said additional bit being in said second state serving to indicate that notes corresponding to a predetermined chord structure are being played, and further including repeating said shifting of said information whenever both of said selected bit and said additional bit are not in said second state and until said selected bit is again in said second state, then again determining the state of said additional bit, and alternately continuing said shifting and determining steps until both of said selected bit and said additional bit are in said second state or until the information is returned to its original state, selecting the relationship between said selected bit and said additional bit so as to correspond to an interval characteristic of either a Major or Minor chord structure, and further including selecting the alternative relationship whenever the sequence of shifting and determining steps fail to determine that a selected bit and additional bit having the first selected relationship are both in the second state.

* * * * *